US012077979B1

(12) United States Patent
Vali

(10) Patent No.: US 12,077,979 B1
(45) Date of Patent: Sep. 3, 2024

(54) FENCE POST COVER

(71) Applicant: Amit Vali, Irving, TX (US)

(72) Inventor: Amit Vali, Irving, TX (US)

( * ) Notice: Subject to any disclaimer, the term of this patent is extended or adjusted under 35 U.S.C. 154(b) by 35 days.

(21) Appl. No.: 17/568,661

(22) Filed: Jan. 4, 2022

Related U.S. Application Data

(60) Provisional application No. 63/133,967, filed on Jan. 5, 2021.

(51) Int. Cl.
*E04H 17/00* (2006.01)

(52) U.S. Cl.
CPC ..... *E04H 17/006* (2021.01)

(58) Field of Classification Search
CPC ..... E04H 17/00; E04H 17/003; E04H 17/006; E04H 17/009; E04H 17/063; E04H 17/08; E04H 17/1447; E04H 17/146; E04H 17/1473; E04H 17/1488
See application file for complete search history.

(56) References Cited

U.S. PATENT DOCUMENTS 822,814 A * 6/1906 Baker ..... E04H 17/006 256/52
3,722,928 A * 3/1973 Skubic ..... F16B 5/0685 217/43 A
9,777,500 B1 * 10/2017 Reisdorff ..... E04H 12/2215
2021/0207396 A1 * 7/2021 Crandall ..... E04H 17/1413

* cited by examiner

*Primary Examiner* — Daniel J Wiley
(74) *Attorney, Agent, or Firm* — Kenneth L. Tolar

(57) ABSTRACT

A fence post cover includes a hollow, U-shaped shell dimensioned to completely encapsulate the exposed portion of a buried fence post. The shell includes an open rear face with a flange outwardly extending from each of two sides. The flange is constructed with multiple, frangible sections that can be selectively detached from the remainder of the flange to create notches that align with the fence rails. Accordingly, the shell is positioned over a fence post and is secured to the fence to decoratively conceal the unsightly fence post and fastening hardware.

8 Claims, 1 Drawing Sheet

FENCE POST COVER

CROSS REFERENCE TO RELATED APPLICATIONS

This application claims priority of provisional application No. 63/133,967 filed on Jan. 5, 2021, the specification of which is incorporated herein by reference.

BACKGROUND OF THE INVENTION

The present invention relates to a cover that aesthetically conceals unsightly fence posts and rail-fastening hardware.

DESCRIPTION OF THE PRIOR ART

A typical wooden fence includes a plurality of juxtaposed slats that are interconnected with horizontal rails extending along an inwardly facing side. The rails are secured to spaced fence posts with hardware, such as U-bolts or similar protruding fasteners. Because wooden posts degrade quicky when buried in soil, metal posts are typically preferred. However, metal posts and the protruding fastening hardware are unsightly and obtrusive, particularly from the occupant's viewpoint. Moreover, the protruding hardware can easily scrape nearby people and pets.

Accordingly, there is currently a need for a device that conceals unsightly fence posts and associated fastening hardware. The present invention addresses this need by providing a decorative cover that is configured to encapsulate an entire fence post.

SUMMARY OF THE INVENTION

The present invention relates to a fence post cover comprising a hollow, U-shaped shell dimensioned to completely encapsulate the exposed portion of a buried fence post. The shell includes an open rear face with a flange outwardly extending from each of two sides. The flange is constructed with multiple, frangible sections that can be selectively detached from the remainder of the flange to create notches that align with the fence rails. Accordingly, the shell is positioned over a fence post and is secured to the fence to decoratively conceal the unsightly fence post and fastening hardware.

It is therefore an object of the present invention to provide a cover that decoratively conceals unsightly fence posts and rail-attachment hardware.

It is therefore another object of the present invention to provide a fence post cover that can be adjusted to accommodate fences with variable rail spacings.

It is yet another object of the present invention to provide a fence post cover that aesthetically enhances a fence.

Other objects, features, and advantages of the present invention will become readily apparent from the following detailed description of the preferred embodiment when considered with the attached drawings and the appended claims.

DESCRIPTION OF THE PREFERRED EMBODIMENT

Figures 1, 2, 3:
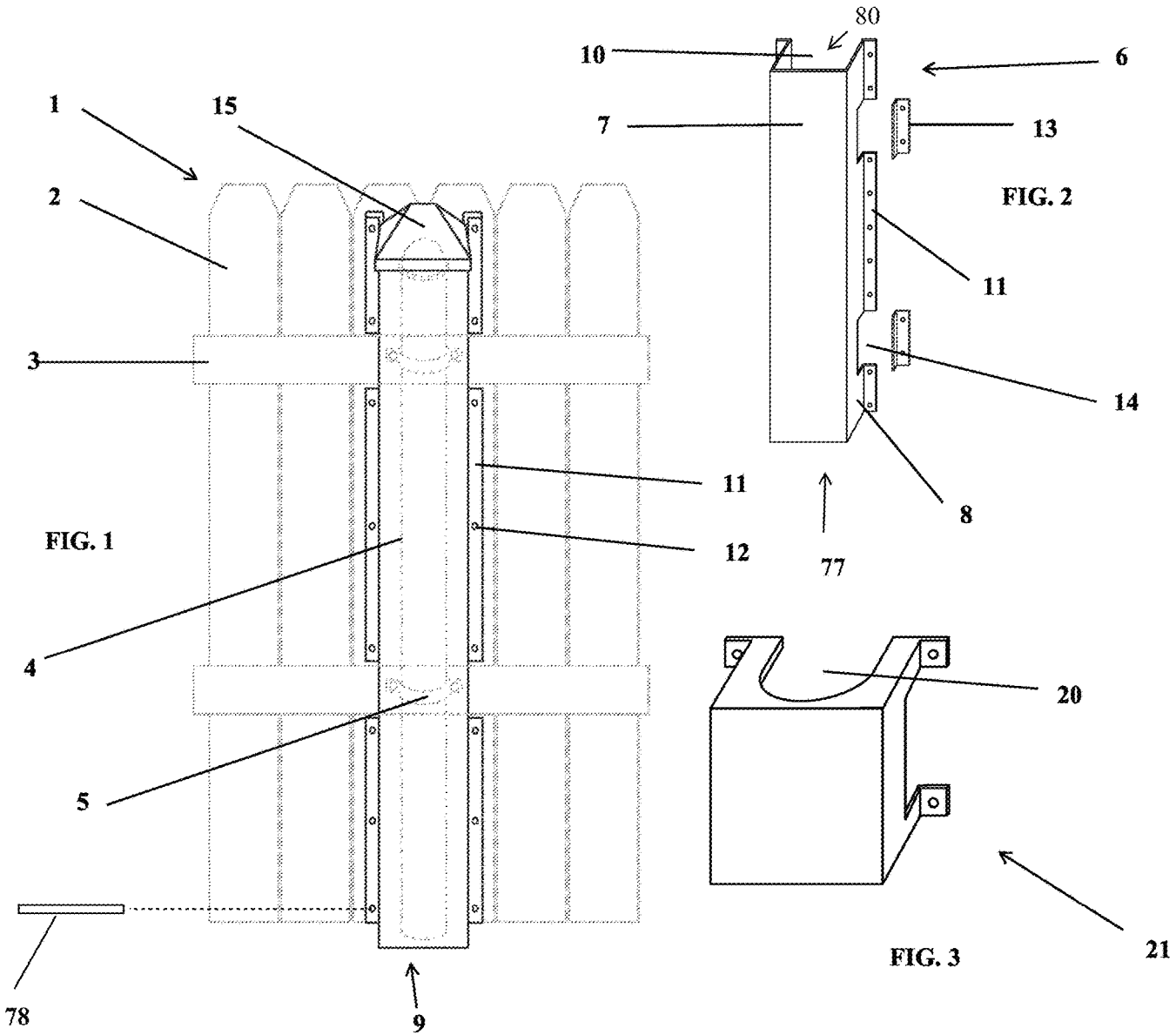
FIG. 1 is an inside, plan view of a fence with the post cover according to the present invention installed thereon.
FIG. 2 is an isolated view of the fence post cover.
FIG. 3 is an isolated view of a different embodiment of the fence post cover.

The present invention relates to a fence post cover for a wooden fence 1 that is typically formed of juxtaposed, vertical slats 2 interconnected with horizontal rails 3 extending along an inwardly facing side. The rails 3 are secured to spaced, buried fence posts 4 with attachment hardware 5 to support the slats in an upright position.

The present invention is a cover 77 for concealing the posts 4 and hardware 5 comprising a hollow shell 6 having a U-shaped cross section with a front wall 7, two spaced, opposing sidewalls 8, an open lower end 9, an open upper end 10 and an open rear face 80. The shell may be constructed with vinyl plastic, high-density polyethylene (HDPE) plastic or a similar equivalent. The shell is dimensioned to completely encapsulate the exposed portion of the buried fence post. Alternatively, as depicted in FIG. 3, the length of the shell of a second embodiment 21 may be truncated to encapsulate only the portion of the rail having the exposed attachment hardware. As such, the open upper and lower ends may include an arcuate recess 20 that conforms to the outer surface of a tubular fence post.

Each sidewall terminates at a free edge having a flange 11 outwardly extending therefrom. The flange includes apertures 12 longitudinally positioned thereon that receive fasteners 78 to secure the shell to a fence slat. Each flange is constructed with multiple, frangible sections 13 that can be selectively detached from the remainder of the flange to create notches 14 that align with the fence rails. The depth of the created notches is such that the shell firmly engages the fence rail to eliminate unsightly gaps between the cover and fence.

A cap 15 is securable to the open upper end of the shell to enhance the appearance of the concealed post and to prevent debris intrusion into the shell interior. The shell and cap exterior can include any number of textures and colors that match, complement, contrast, or aesthetically blend with the fence or the adjacent building. For example, the cap and shell could have a faux wood finish that resembles the fence. The shell and cap could also be randomly colored or include decorative elements or themes.

To install the cover, a user positions the shell over a fence post and secures it to the slats with screws or nails. Accordingly, the attached shell decoratively conceals the unsightly fence post and the fastening hardware.

The above-described device is not limited to the exact details of construction and enumeration of parts provided herein. For example, although the device has been primarily depicted and described as being used on wooden fences with vertical slats, it is equally applicable to fences with horizontal slats, board-on-board fences or any other type of fence construction having the disadvantages described herein. Moreover, the device could be used with other types of posts having unsightly and protruding hardware, such as a street-sign post. Furthermore, the size, shape, and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A fence assembly, comprising:

a fence comprising a plurality of juxtaposed slats interconnected with rails, said rails secured to a plurality of spaced apart, buried fence posts by attachment hardware to support the slats in an upright position, and a cover for concealing the posts and the attachment hardware, said cover comprising:

a hollow shell having a front wall, a pair of spaced, opposing sidewalls attached to one or more of said slats, an open lower end, an open upper end, and an open rear face in communication with a recess that receives a portion of one of said fence posts and said attachment hardware; and means for fastening said hollow shell to at least one of said juxtaposed slats.

2. The fence assembly according to claim 1 wherein said means for fastening said hollow shell to at least one of said juxtaposed slats comprises:

a flange outwardly extending from each of said opposing sidewalls;

a plurality of apertures longitudinally positioned on said flange;

a fastener received within each of said apertures and secured to said at least one of said juxtaposed slats.

3. The fence assembly according to claim 2 wherein said flange is constructed with multiple, frangible sections that are selectively detachable from the remainder of the flange to create notches that align with said rails.

4. The fence assembly according to claim 1 wherein the open upper end and the open lower end of said hollow shell each include an arcuate recess that conforms to an outer surface of each one of the plurality of fence posts.

5. The fence assembly according to claim 1 further comprising a cap securable to the open upper end of the hollow shell to aesthetically enhance the post and to prevent debris intrusion into the hollow shell.

6. The fence assembly according to claim 5 wherein an exterior surface of said hollow shell and said cap aesthetically blend with said rails and said posts.

7. The fence assembly according to claim 1 wherein said hollow shell is dimensioned to completely encapsulate an exposed portion of each of the plurality of buried fence posts.

8. The fence assembly according to claim 1 wherein a length of the hollow shell is configured to encapsulate only said attachment hardware.

* * * * *